US010729611B2

(12) United States Patent
Ode

(10) Patent No.: US 10,729,611 B2
(45) Date of Patent: Aug. 4, 2020

(54) CHAIR-TYPE MASSAGE MACHINE

(71) Applicant: FUJI MEDICAL INSTRUMENTS MFG. CO., LTD., Osaka-shi, Osaka (JP)

(72) Inventor: Kentaro Ode, Osaka (JP)

(73) Assignee: FUJI MEDICAL INSTRUMENTS MFG. CO., LTD., Osaka-Shi, Osaka (JP)

( * ) Notice: Subject to any disclaimer, the term of this patent is extended or adjusted under 35 U.S.C. 154(b) by 1010 days.

(21) Appl. No.: 15/009,663

(22) Filed: Jan. 28, 2016

(65) Prior Publication Data

US 2016/0317382 A1 Nov. 3, 2016

(30) Foreign Application Priority Data

Apr. 28, 2015 (JP) ..... 2015-091588

(51) Int. Cl.
*A61H 7/00* (2006.01)
*A61H 9/00* (2006.01)
(Continued)

(52) U.S. Cl.
CPC ..... *A61H 7/007* (2013.01); *A61H 9/0078* (2013.01); *A61H 15/0078* (2013.01);
(Continued)

(58) Field of Classification Search
CPC .. A61H 7/007; A61H 9/0078; A61H 15/0078; A61H 23/02; A61H 2201/0207;
(Continued)

(56) References Cited

U.S. PATENT DOCUMENTS 6,494,850 B1 * 12/2002 Kitadou ..... A47C 3/02 601/49
7,081,099 B1 * 7/2006 Luo ..... A61H 7/00 601/103
(Continued)

FOREIGN PATENT DOCUMENTS

JP 09-010268 A 1/1997
JP 2004-215780 A 8/2004
(Continued)

OTHER PUBLICATIONS

English translation for JP2005-185422, espacenet.com, translated on Jan. 29, 2019.*
(Continued)

*Primary Examiner* — Tu A Vo
(74) *Attorney, Agent, or Firm* — Mausvalley&Partners

(57) ABSTRACT

A massage machine for providing massage which includes a seat portion on which a person to be treated sits; a backrest portion provided at a rear side of the seat portion; a backrest operation portion for changing an angle of the backrest portion in a range of a standing position to a reclining position which reclines back; and a kneading ball type, a vibration type and/or the roller type and air-bag style massage portions. The massage machine further includes either a stand-by mode for maintaining the reclining position of the backrest portion, or a restoring mode for automatically restoring the backrest portion from the reclining position to the standing position.

8 Claims, 9 Drawing Sheets

(51) Int. Cl.
*A61H 15/00* (2006.01)
*A61H 23/00* (2006.01)
*A61H 23/02* (2006.01)

(52) U.S. Cl.
CPC ..... *A61H 23/02* (2013.01); *A61H 2201/025* (2013.01); *A61H 2201/0207* (2013.01); *A61H 2201/5035* (2013.01); *A61H 2201/5046* (2013.01); *A61H 2201/5069* (2013.01); *A61H 2205/081* (2013.01); *A61H 2205/106* (2013.01); *A61H 2205/108* (2013.01); *A61H 2205/12* (2013.01)

(58) Field of Classification Search
CPC ..... A61H 2201/025; A61H 2201/5035; A61H 2201/5046; A61H 2205/081; A61H 2205/106; A61H 2201/5069; A61H 2205/108; A61H 2025/12
See application file for complete search history.

(56) References Cited

U.S. PATENT DOCUMENTS 7,239,096 B2 * 7/2007 Hancock ..... B60N 2/0228 318/50
2002/0145512 A1 * 10/2002 Sleichter, III ..... B60N 2/56 340/407.1
2004/0158181 A1 * 8/2004 Watanabe ..... A61H 7/007 601/99
2005/0222523 A1 * 10/2005 Splane, Jr. ..... A61H 1/001 601/5
2006/0217642 A1 * 9/2006 Tanizawa ..... A61H 1/00 601/98
2008/0030053 A1 * 2/2008 Kamba ..... A61H 1/003 297/217.3
2008/0048475 A1 * 2/2008 Tanizawa ..... 297/284.6
2008/0077060 A1 * 3/2008 Liang ..... A61H 7/007 601/99
2008/0252116 A1 * 10/2008 Phillips ..... A61H 1/003 297/217.1
2009/0021063 A1 * 1/2009 Morita ..... A47C 1/02 297/319
2009/0121660 A1 * 5/2009 Rawls-Meehan .... A47C 20/041 318/16
2010/0198120 A1 * 8/2010 Tago ..... A61H 1/0237 601/134
2010/0249613 A1 * 9/2010 Hashimoto ..... A61B 5/02405 600/485
2011/0055720 A1 * 3/2011 Potter ..... G06F 3/017 715/747
2014/0265497 A1 * 9/2014 Hough ..... A61G 5/14 297/316

FOREIGN PATENT DOCUMENTS

JP 2005-18373 A 7/2005
JP 2005-185422 A 7/2005
JP 2005185422 A * 7/2005
JP 2011-092513 A 5/2011
JP 2015-027405 A 2/2015

OTHER PUBLICATIONS

JPO, Notice of Rejection dated Oct. 16, 2018 in JP Patent Application No. 2015-091588, total 8 pages with English translation.
Japan Patent Office, Notice of Rejection dated May 7, 2019 in Japanese Patent Application No. 2015-091588, total 8 pages with English translation.

* cited by examiner

FIG. 4A

65

81

| Automatic Course List | Automatic Course Identification Code |
|---|---|
| Whole Body Fatigue Relieving Course | A |
| Whole Body Stretching Course | B |
| Whole Body Air Course | C |
| Partial Body Concentrating Course | D |

FIG. 4B

66

82

| Course Finishing Time Setting Position List | | | Course Finishing Time Setting Position Identification Code |
|---|---|---|---|
| Stand-by Mode | | | 01 |
| Immediately Restoring Mode | | | 02 |
| Delayed Restoring Mode | Delay Time | 5 Minutes | 03a |
| | | 30 Minutes | 03b |
| | | 60 Minutes | 03c |
| | | Time Setting | 03d |
| Forced Reclining Position Mode | | | 04 |
| Forced Standing Position Mode | | | 05 |

CHAIR-TYPE MASSAGE MACHINE

This application claims priority under 35 U.S.C. § 119 to Japanese patent application Serial No. 2015-091588, filed Apr. 28, 2015, which is incorporated herein by reference in its entirety.

FIELD OF THE INVENTION

The present invention pertains to a chair-type massage machine. The chair-type massage machine includes a seat portion on which a person to be treated sits, a backrest portion provided at a rear side of the seat portion, a backrest operation portion for changing an angle of the backrest portion in a range of a standing position to a reclining position which reclines back, and a massage means.

BACKGROUND OF THE INVENTION

Conventionally, it is widely known that some chair-type massage machines are provided with a reclining function being capable of changing a backrest portion to be a reclining position which reclines back. when the backrest portion takes the reclining position at the time, for example, when a massage is finished and/or a massage is stopped in the middle of the massage, some of the chair-type massage machines provided with the reclining function can be stopped with maintaining the reclining position by some reasons such as resetting individually registered information about a registered massage per person to be treated.

When such a chair-type massage machine was used, a remote controller was manually used to restore the backrest portion from the reclining position to a standing position which was an original position where the backrest portion stood.

However, when the backrest portion is manually restored to the standing position by the manual operation, for example, a person to be treated is forced to reach the remote controller positioned at near one of the armrests and is forced to keep pressing a reclining position adjusting switch of the remote controller until the backrest portion is restored to be a desired standing position, while keeping the head portion of the person up from the backrest portion. Doing such a restoring operation right after a massage was annoying to the person who just had gotten relaxed from the massage because the relaxed feeling could be spoiled by the restoring operation.

Further, most of the chair-type massage machines usually have a shape in which a person to be treated can lounge back to make it possible that the chair-type massage machine can hold the person so that the person's body is not displaced from the seat portion and/or the backrest portion of the massage machine in the middle of a massage after the chair-type massage machine detects the positions where the massage should be given at, and that the seat portion and the backrest portion of the person can be covered so that the person can get a massage effect. Therefore, it was a burden for the people who were powerless, especially the old and/or women to restore the backrest portion to the standing position in the manner described above.

On the other hand, there are chair-type massage machines in which the backrest portion taking the reclining position can be automatically restored to be the standing position right after a massage is finished.

The chair type treating device is provided with a notifying function which notifies a person to be treated of the end of the treatment when the backrest portion is automatically restored to be its home position, that is, the standing position at the end of the treatment. However, in the chair type treating device, the upper body of the person to be treated is still raised in association with the position change of the backrest portion to the standing position at the end of the treatment, regardless of the person's will.

That is, some people to be treated may want to be relaxed with keeping the reclining position even after a massage is finished. Therefore, if the backrest portion is uniformly changed to be the standing position regardless of such a feeling described above, the relaxed feeling obtained from the massage can be spoiled. As a result of this, there was a possibility that those people were not able to be satisfied, and the comfortableness could be spoiled.

SUMMARY OF THE INVENTION

One embodiment of the present invention is a chair-type massage machine including:

a seat portion on which a person to be treated sits;

a backrest portion provided at a rear side of the seat portion;

a backrest operation portion for changing an angle of the backrest portion in a range of a standing position to a reclining position which reclines back; and a massage means, wherein the chair-type massage machine includes a selecting means, and when individually registered information about a registered massage per person to be treated is reset and the backrest portion takes the reclining position, the selecting means allows either a stand-by mode for maintaining the reclining position of the backrest portion, or a restoring mode for automatically restoring the backrest portion from the reclining position to the standing position, to be selectable.

BRIEF DESCRIPTION OF DRAWINGS

FIG. 4A and FIG. 4B are schematic diagrams of an automatic course list table and a course finishing time setting position list table.

DETAILED DESCRIPTION OF THE PREFERRED EMBODIMENTS

Figure 1:
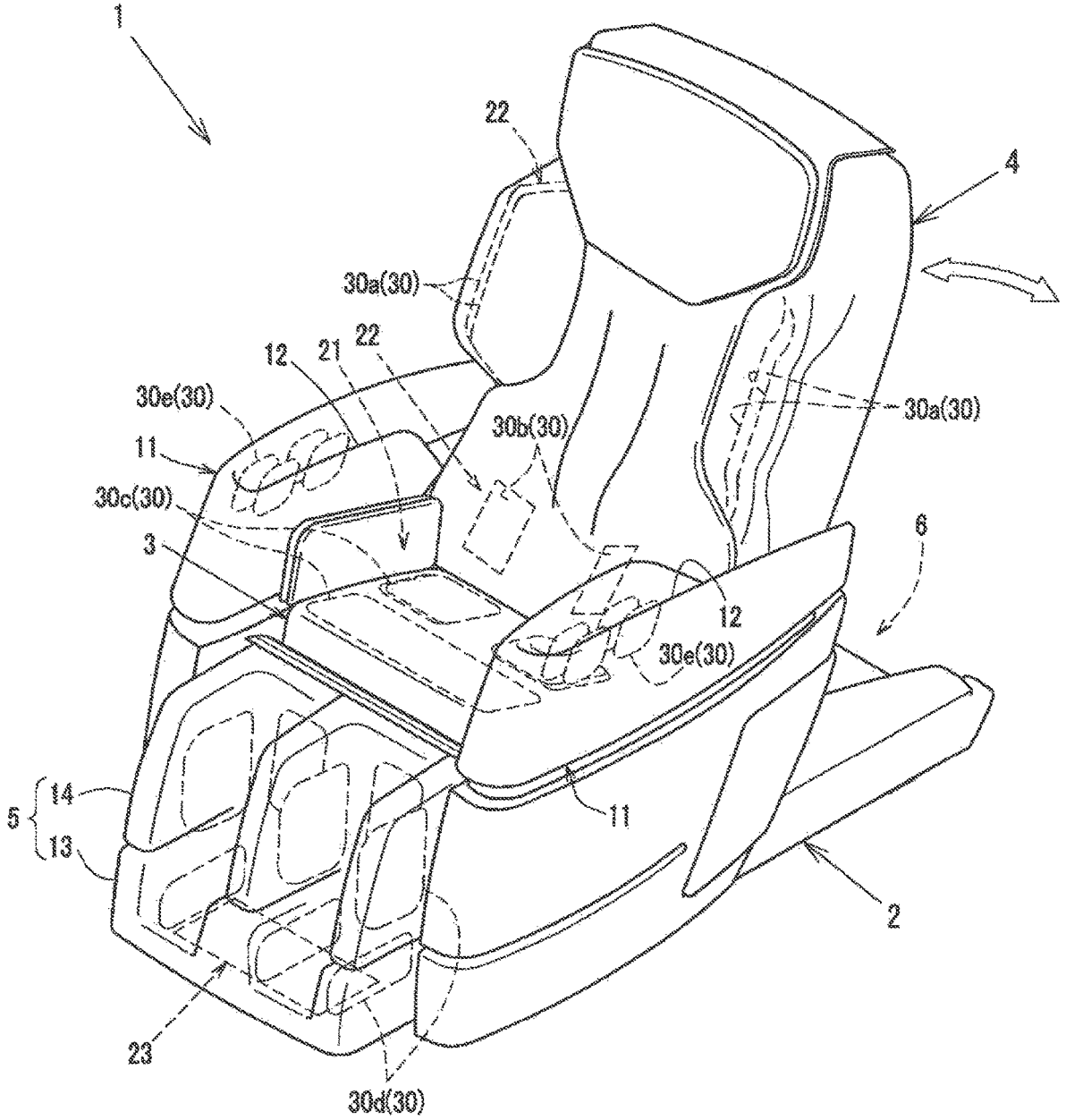
FIG. 1 is an external view of a chair-type massage machine of the present invention.
Figure 2:
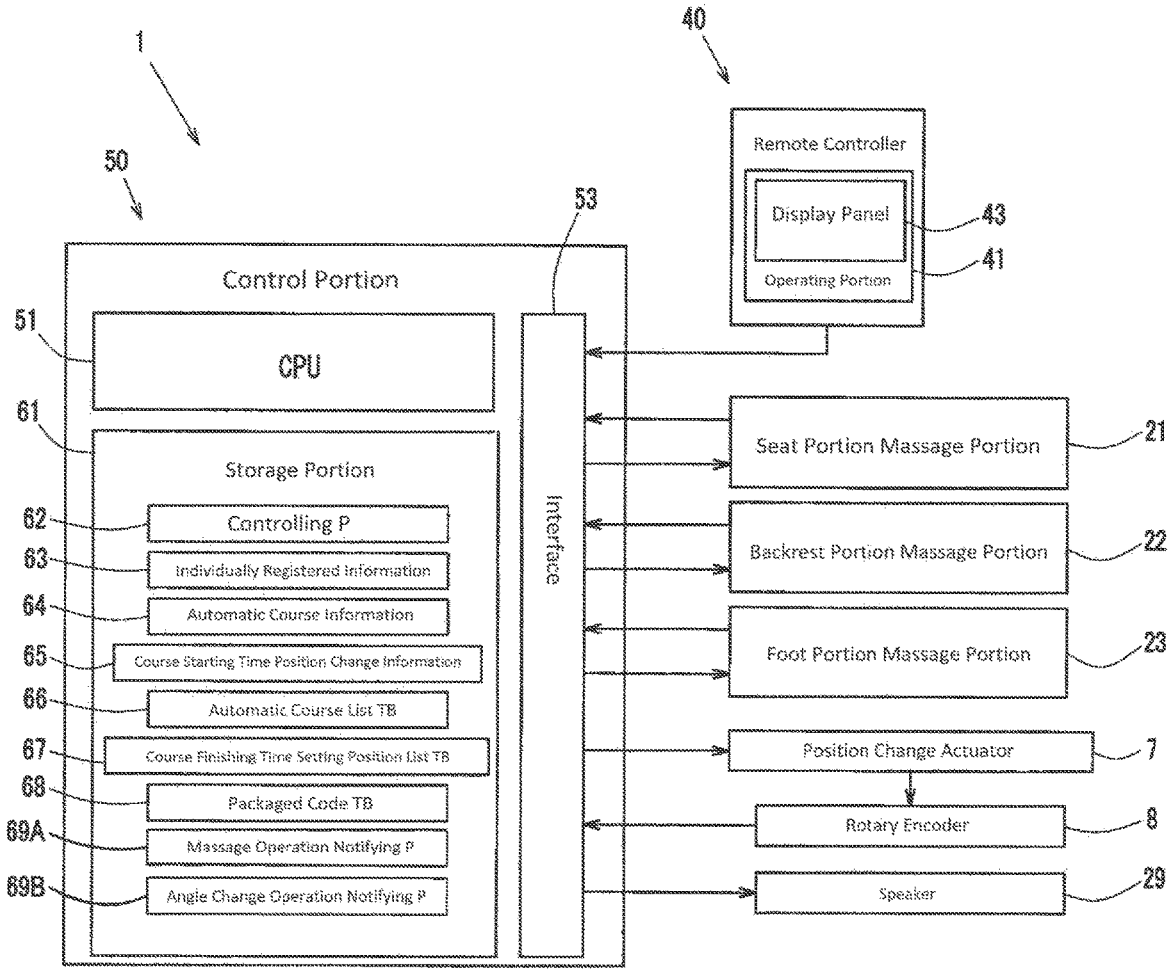
FIG. 2 is a block diagram illustrating the schematic structure of a chair-type massage machine of the present invention.

Embodiments of the present invention will be explained below with referring to figures. FIG. 1 illustrates an external view of a chair-type massage machine 1 of the present invention. FIG. 2 is a block diagram illustrating a schematic structure of the chair-type massage machine of the present embodiment. In the chair-type massage machine 1, a seat portion 3 on which a person to be treated sits is supported by a base portion 2 which is placed on a floor surface. A backrest portion 4 which the back portion of the person to be treated touches is supported by the rear end side of the seat portion 3, and a footrest portion 5 which accommodates the foot portion of the person to be treated is supported by the front end side of the seat portion 3.

The seat portion 3, the backrest portion 4, and the footrest portion 6 are independently capable of reclining against the base portion 2 by a position change mechanism 6. The position change mechanism 6 includes a plurality of position change actuators 7 (FIG. 2) and a link mechanism (not shown) which transmits the drives of the position change actuators 7 to the seat portion 3, the backrest portion 4, and the footrest portion 5. The position change mechanism 6 has a configuration to individually or cooperatively operate the seat portion 3, the backrest portion 4, and the footrest portion 5. At a rotation shaft of the position change actuator 7, a rotary encoder 8 (FIG. 2) for detecting a rotation angle is attached, and obtained angle information is outputted to a control portion 50.

With this structure, the backrest portion 4 has a configuration in which an angle of the backrest portion 4 can be changed in the range of a standing position which supports the back portion of a person to be treated when the person sits and a reclining position which reclines backward from the standing position. Also, the footrest portion 5 has a configuration in which an angle of the footrest portion 5 can be changed in the range of a waiting position and a protruding position which substantially horizontally protrudes in the front direction. Incidentally, in the present embodiment, when the backrest portion 4 takes the standing position, the footrest portion 5 is assumed to take the waiting position unless indicated otherwise. Also, when the backrest portion 4 takes the reclining position, the footrest portion 5 is assumed to take the protruding position unless indicated otherwise.

At both of the right and left sides of the seat portion 3, elbow resting portions 11, being capable of reclining together with the seat portion 3 toward the base portion 2, are provided. The elbow resting portion 11 is provided with an arm insertion recess portion 12 in which the forearm portion (the portion under the elbow) of a person to be treated is inserted when the person puts the elbow on the elbow resting portion.

Also, as shown in FIG. 1, the footrest portion 5 has a foot placing portion 13 on which the foot of the person to be treated is placed when the waiting position is taken, and a foot insertion recess portion 14 in which the foot portion (the lower thigh) is inserted.

As shown in FIGS. 1 and 2, the seat portion 3, the backrest portion 4, and the footrest portion 5 are provided with a seat portion massage portion 21, a backrest portion massage portion 22, and a foot portion massage portion 23, respectively. The seat portion massage portion 21, the backrest portion massage portion 22, and the foot portion massage portion 23 are all for giving a massage to a person to be treated.

Each of the seat portion massage portion 21, the backrest portion massage portion 22, and the foot portion massage portion 23 are each provided with an air-style configuration composed of an air bag 30 and/or an air supply and exhaust device and a machine-style configuration (not shown) composed of, for example, a vibration type and a roller type.

As a machine-style massage means, the backrest portion massage portion 22 has a massage means of a kneading ball type (not shown) which moves up and down in the longitudinal direction of the backrest portion 4, in addition to a massage means of the vibration type and/or the roller type described above.

Incidentally, a rotary encoder for detecting a rotation angle is attached to a rotation shaft of a massage actuator which actuates these machine-style massage means, and obtained angle information is outputted to the control portion 50.

As shown in FIG. 1, the-air style massage means has a plurality of air bags 30 which expand by the air supply and press a treatment spot of the human body. Also, the air-style massage means has an air supply and exhaust device (not shown) which includes a pump supplying the air to the air bag 30 and a valve positioned between the pump and the air bag 30. As shown in FIG. 1, each air bag 30, for example, a shoulder air bag 30*a*, a lower back air bag 30*b*, a seat portion air bag 30*c*, a foot portion air bag 30*d*, and an arm portion air bag is attached to the corresponding spot.

When a plurality of air bags 30*d* attached to the foot insertion recess portion 14 and the foot placing portion 13 are focused on as one example of the air-style foot portion massage portion 23, it is understood that the calves and/or the ankles and the toes of a person to be treated can be massaged by being sandwiched by the air bags 30*d* which expand and contract.

Also, as shown in FIG. 2, the chair-type massage machine 1 has a speaker 29 which gives a sound and/or a voice announcement to a person to be treated, based on a direction from the control portion 50. In addition, the chair-type massage machine 1 has heaters (not shown) at the corresponding spots. The heaters can warm up a place around the lower back and/or the toes by giving warm air with a controlled temperature.

Figure 3:
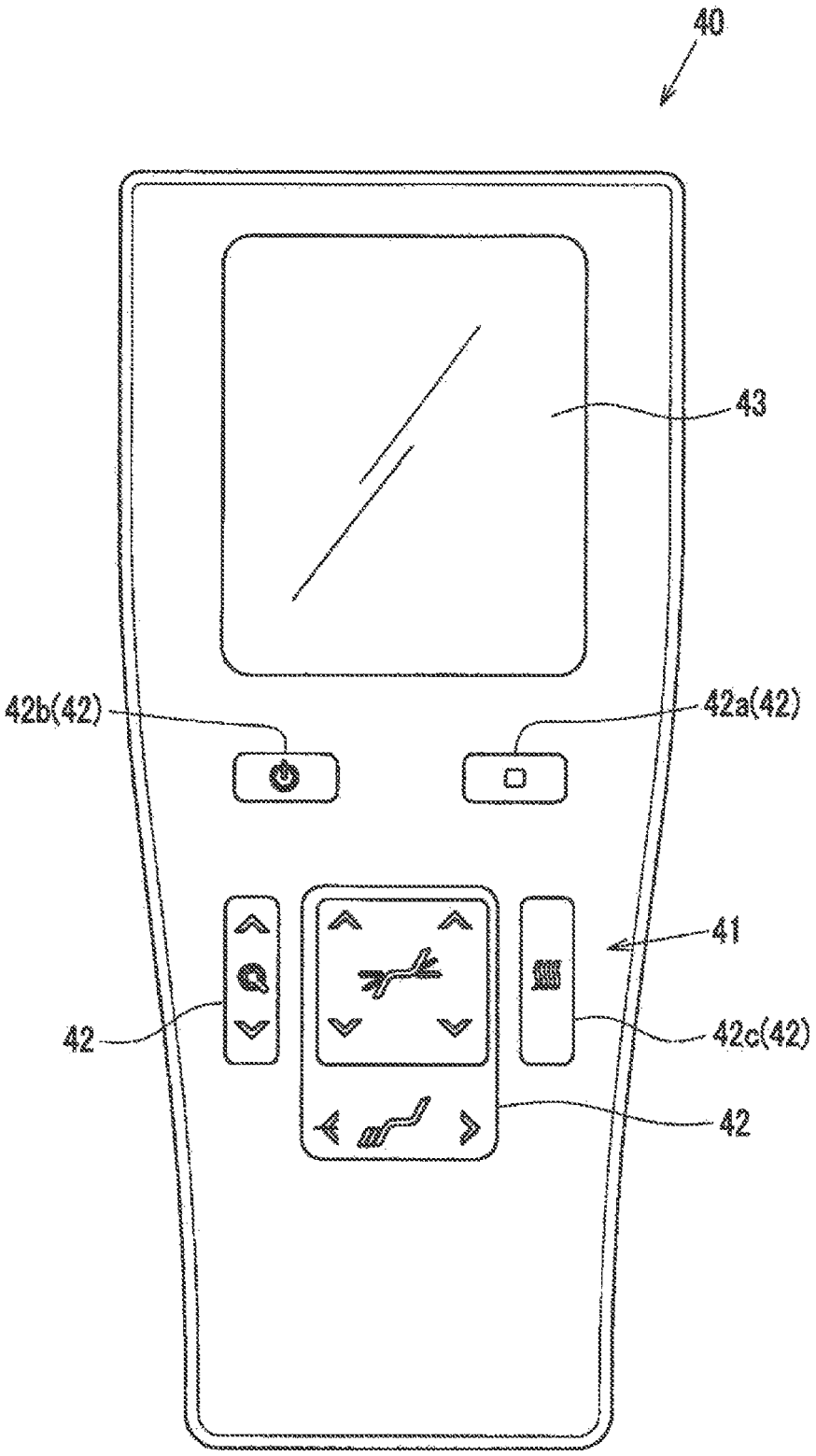
FIG. 3 is a front view of a remote controller provided at a chair-type massage machine of the present invention.

The operation of the chair-type massage machine 1 is conducted using a remote controller 40 which is provided at one of the elbow resting portions 11, as shown in FIG. 3.

The remote controller 40 has an operating portion 41 on which a power ON/OFF button 42*a*, a start/stop button for starting/stopping a massage of an automatic course which is described later, a heater ON/OFF button 42*c*, and a plurality of operation buttons 42 for adjusting a massage point and/or a position (an angle and a spot) of the backrest portion 4 and/or the footrest portion 5 are disposed.

Incidentally, the power ON/OFF button 42*a* provided at the operating portion 41 is connected to the main power of the chair-type massage machine 1, and is a relay type switch which is turned on or off by the operation of the remote controller 40. The power ON/OFF button 42*a* also has a massage sudden stop function.

Further, the remote controller 40 has a touch panel type display panel 43. The touch panel type display panel 43 can displace massage information such as the operation status, the position, the strength, the past time of the selected automatic course and/or of the massage portions 21, 22, and 23. Also, the touch panel type display panel 43 allows various selection menus displayed on a selection screen to be selectable by touching the various selection menu.

As shown in FIG. 2, the control portion 50 has a CPU 51 composed of a microprocessor and the like, and a storage portion 60 which stores various controlling programs, massage setting information, and the like, and is electrically connected to each of the remote controller 40 and/or the position change actuators 7 for operating the backrest portion 4 and the footrest portion 5 and/or the rotary encoder 8 for detecting the rotation angle of these position change actuators 7 through an interface 53.

Further, the control portion 50 is electrically connected to the air pump and the air supply and exhaust device for the air bag 30 as well as a drive motor which makes the machine-style massage means (for example, a roller, a kneading ball, and a vibration) arbitrarily provided at the massage portions 21, 22, and 23 move (tapping, kneading, moving up and down, giving a vibration, and the like), through the interface 53.

With the structure described above, when the automatic course is selected by the operation of the operating portion 41 and the massage is started by pressing the start/stop button 42*b*, based on a controlling program 62 stored in the control portion 50 beforehand, the massage portions 21, 22, and 23 are operated and the tapping movement, the kneading movement, and the expand and the contract of the air bag 30 are controlled.

Here, the automatic course means a course programmed to massage a plurality of treatment spots with a plurality of massage forms of the air-style configuration and/or the machine-style configuration combined in a predetermined order by taking a predetermined time, for example, 20 minutes in total. In the present embodiment, there are, for example, a whole body fatigue relieving course, a whole body stretching course, a whole body air course, and a partial body concentrating course prepared.

In the storage portion 61, various information is stored such as the controlling program 62, individually registered information 63, and automatic course information 64 based on a timing chart of each automatic course for the purpose of the fatigue relieving and/or stretching. Also, an automatic course list table 66, a course finishing time setting position list table 67, and a packaged code table 68, and the like are stored and these are described later. Here, the individually registered information 63 is the information about a registered massage per person to be treated, such as the body information, the strength and/or the speed of a massage, a massage spot of the person to be treated. In the present embodiment, the individually registered information 63 is reset when the power ON/OFF button 42*a* and/or the start/stop button 42*b* is pressed to stop a massage or when an automatic course is finished.

The CPU 51 executes the controlling program 62 which actuates the massage portions 21, 22, and 23 and/or the position change actuator 7 based on the information described above which is stored in the storage portion 61.

That is, in association with the beginning of the selected automatic course based on the controlling program 62, the control portion 50 of the present embodiment executes the control which allows either an automatically reclining mode for automatically reclining the position of the chair-type massage machine 1 at the time of the beginning of the course from the standing position to the reclining position, or a manually reclining mode (an operational reclining mode) for reclining the position by operating the operating portion 41, to be selectable.

Further, some automatic courses, for example, the whole body fatigue relieving course take the reclining position at the beginning of the course, and this depends on contents of the automatic course. In this case, when a person to be treated selects the automatic course, the control portion 50 executes the control which displays a course starting time position change selecting screen 72 which allows the selection menu of either "the automatically reclining mode" 72*a* or "the manually reclining mode" 72*b* to be selectable by the person on the display panel 43 of the remote controller 40, as shown in FIG. 8B.

In addition, when "the automatically reclining mode" 72*a* described above is selected by the person to be treated, the control portion 50 executes the control which actuates each position change actuator 7 for the backrest portion 4 and/or the footrest portion 5 based on the controlling program 62 so that the backrest portion 4 is reclined to be the reclining position at a suitable angle for contents of a massage at the beginning of the course.

Furthermore, when a massage is finished or a massage is stopped by a person to be treated by pressing the stop button 42*b* and/or the power ON/OFF switch 42*a* of the remote controller 40, that is, when the individually registered information 63 is reset, if the backrest portion 4 takes the reclining position, the control portion 50 of the present embodiment executes the control based on the controlling program 62. The control allows, basically, either "a stand-by mode" 73*a* for maintaining the reclining position of the backrest portion 4, or "a restoring mode" 73*b*, 73*c* for automatically restoring the backrest portion 4 from the reclining position to the standing position, to be selectable by the person using the remote controller 40.

However, by depending on the attribute of a selected automatic course, the control portion 50 executes the control which changes a position of the backrest portion 4 at the end of the automatic course to a course finishing time setting position which is predetermined by associating with the automatic course, regardless of a person's selection of a position which the backrest portion 4 will take when the individually registered information 63 is reset.

Such a controlling program 62 is stored in the storage portion 61. The controlling program 62 can execute based on the direction by the CPU 51 using the various tables 65, 66 illustrated in FIG. 4A, FIG. 4B, FIG. 5A, and FIG. 5B, which are one example of the present embodiment.

FIG. 4A is a schematic diagram illustrating an automatic course list table 65 showing the relation between various automatic courses and an automatic course identification code 81. FIG. 4B is a schematic diagram illustrating a course finishing time setting position list table 66 showing the relation between various courses finishing time setting position and a course finishing time setting position identification code 82.

As shown in FIG. 4A, in the automatic course list table 65, a whole body fatigue relieving course, a whole body stretching course, a whole body air course, and a partial body concentrating course are registered as the automatic course. These automatic courses are associated with their corresponding automatic course identification code 81, individually ("A", "B" "C", and "D").

As shown in FIG. 4B, in the course finishing time setting position list table 66, a stand-by mode, an immediately restoring mode, a delayed restoring mode, a forced reclining position mode (a forced stand-by mode), and a forced standing position mode (a forced restoring mode) are registered as the course finishing time setting position mode. These course finishing time setting position modes are associated with their corresponding course finishing time setting position identification code 82, individually ("01", "02", "03*", "04", and "05").

Further, the delayed restoring mode has four types of the course finishing time setting position identification code 82 ("03*a*", "03*b*", "03*c*", and "03*d*"). (Refer to FIG. 4B.) The course finishing time setting position identification code "03*a*", "03*b*", and "03*c*" are associated with the three types of fixed delay times (the stand-by time) of 5 minutes, 30 minutes, and 60 minutes, respectively. Also, the course finishing setting position identification code "03*d*" is associated with a delay time which can be arbitrarily set by the operation of the remote controller 40 by a person to be treated.

Here, the stand-by mode is for maintaining the reclining position of the backrest portion 4 when the individually registered information is reset. The immediately restoring mode is for automatically restoring the backrest portion 4 from the reclining position to the standing position when the individually registered information is reset. The delayed restoring mode is for restoring the backrest portion 4 after a predetermined time is passed from the time when a massage is finished. The forced reclining position mode (the forced stand-by mode) is for maintaining the reclining position regardless of a selection by the remote controller 40. The forced standing position mode (the forced restoring mode) is for automatically restoring the backrest portion 4 from the reclining position to the standing position regardless of a selection by the remote controller 40.

Figure 5A:
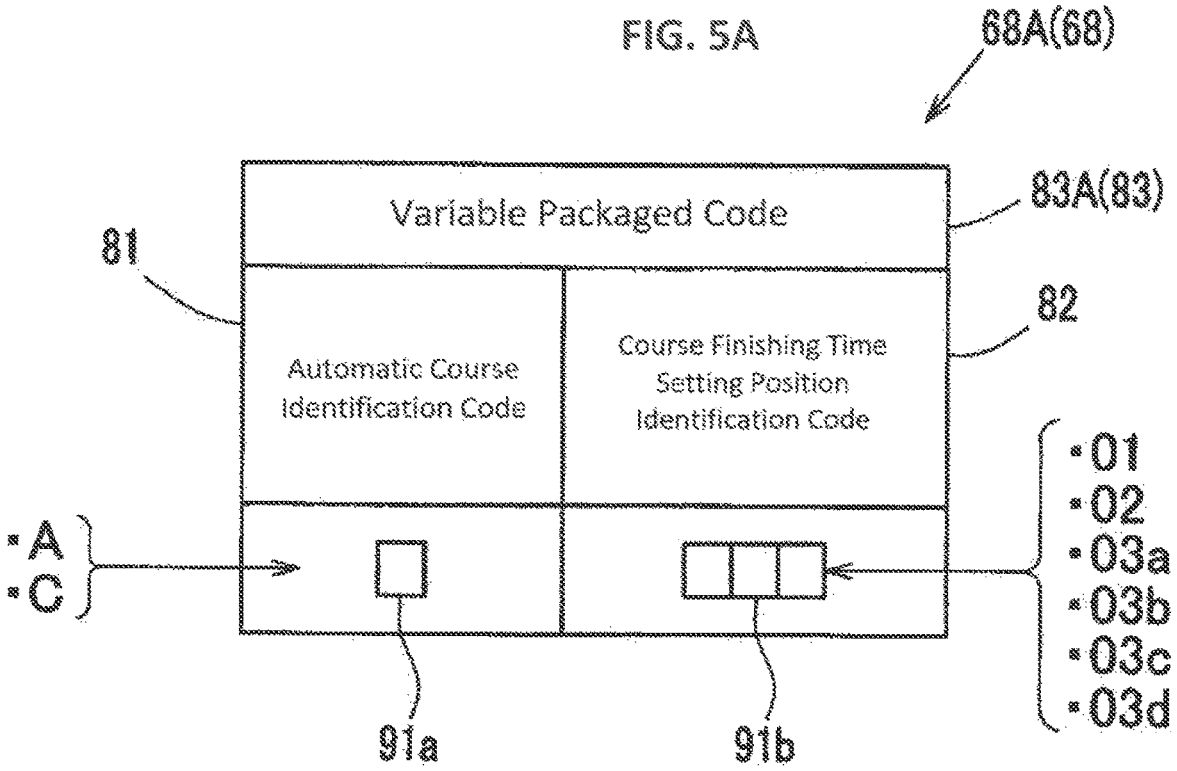
FIG. 5A and FIG. 5B are schematic diagrams of a packaged code table.
Figure 5B:
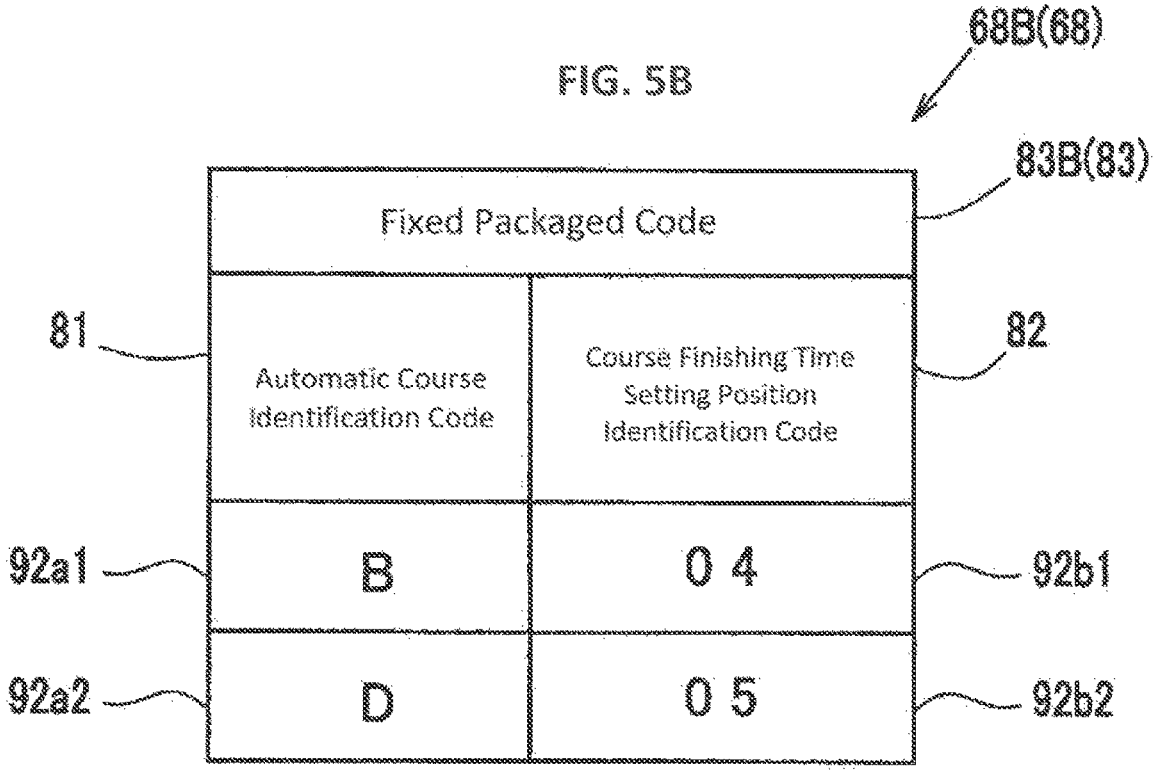

Both of FIGS. 5A and 5B are schematic diagrams illustrating a packaged code table 68 where a packaged code 83 associating the automatic course identification code 81 and the course finishing time setting position identification code 82 is stored. FIG. 5A is a schematic diagram illustrating a variable packaged code table 83A, while FIG. 5B is a schematic diagram illustrating a fixed packaged code table 83B.

The packaged code 83 is stored in the packaged code table 68 of the storage portion 61. The package code 83 has the variable packaged code 83A and the fixed packaged code 83B. As shown in FIG. 5A, the variable packaged code 83A is stored in the memory space assigned in the storage portion 61 such that the automatic course identification code 81 and the course finishing time setting position identification code 82 are arranged in a line and they are rewritable. As shown in FIG. 5B, the automatic course identification code 81 and the course finishing time setting position identification code 82 are stored beforehand by being associated with each other so as to have one to one relationship in the fixed packaged code 83B.

For example, as shown in FIG. 5A, either "A" or "C" of the automatic course identification code 81 among the various automatic courses shown in FIG. 4A can be written in an automatic course identification code domain 91*a* in the variable packaged code 83A. The automatic course identification code 81 "A" and "C" correspond to the whole body fatigue relieving course and the whole body air course, respectively.

Further, any one of "01", "02", and "03*" of the course finishing time setting position identification code 82 among the course finishing time setting position modes shown in FIG. 4B can be written in a course finishing time setting position identification code domain 91*b* in the variable packaged code 83A. The course finishing time setting position identification code 82"01", "02", and "03*" correspond to the stand-by mode, the immediately restoring mode, and each delayed restoring mode having each delay time, respectively.

On the other hand, as shown in FIG. 5B, in the fixed packaged code 83B, for example, the automatic course identification code 81 "B" corresponding to the whole body stretching course of FIG. 4A is stored in an automatic course identification code domain 92*a*1. Also, In a course finishing time setting position identification code domain 92*b*1 corresponding to the automatic course identification code 81 "B," the course finishing setting position identification code 82 "04" corresponding to the forced reclining position mode of FIG. 4B is stored.

In such a way, by associating the whole body stretching course with the forced standing position mode in the fixed packaged code 83B, it is possible to have a setting where the backrest portion 4 is forced to be automatically restored to the standing position even if the position of the backrest portion 4 at the end of the whole body stretching course takes the reclining position.

Further, as shown in FIG. 5B, in the fixed packaged code 83B, as another example, the automatic course identification code 81 "D" corresponding to the partial body concentrating course of FIG. 4A is stored in an automatic course identification code domain 92*a*2. Also, In a course finishing time setting position identification code domain 92*b*2 corresponding to the automatic course identification code 81 "D," the course finishing time setting position identification code 82 "05" corresponding to the forced standing position mode of FIG. 4B is stored.

In such a way, by associating the partial body concentrating course with the forced standing position mode in the fixed packaged code 83B, it is possible to have a setting where the backrest portion 4 is forced to maintain the standing position which is the position that the backrest portion 4 takes when the partial body concentrating course is finished.

Figure 7:
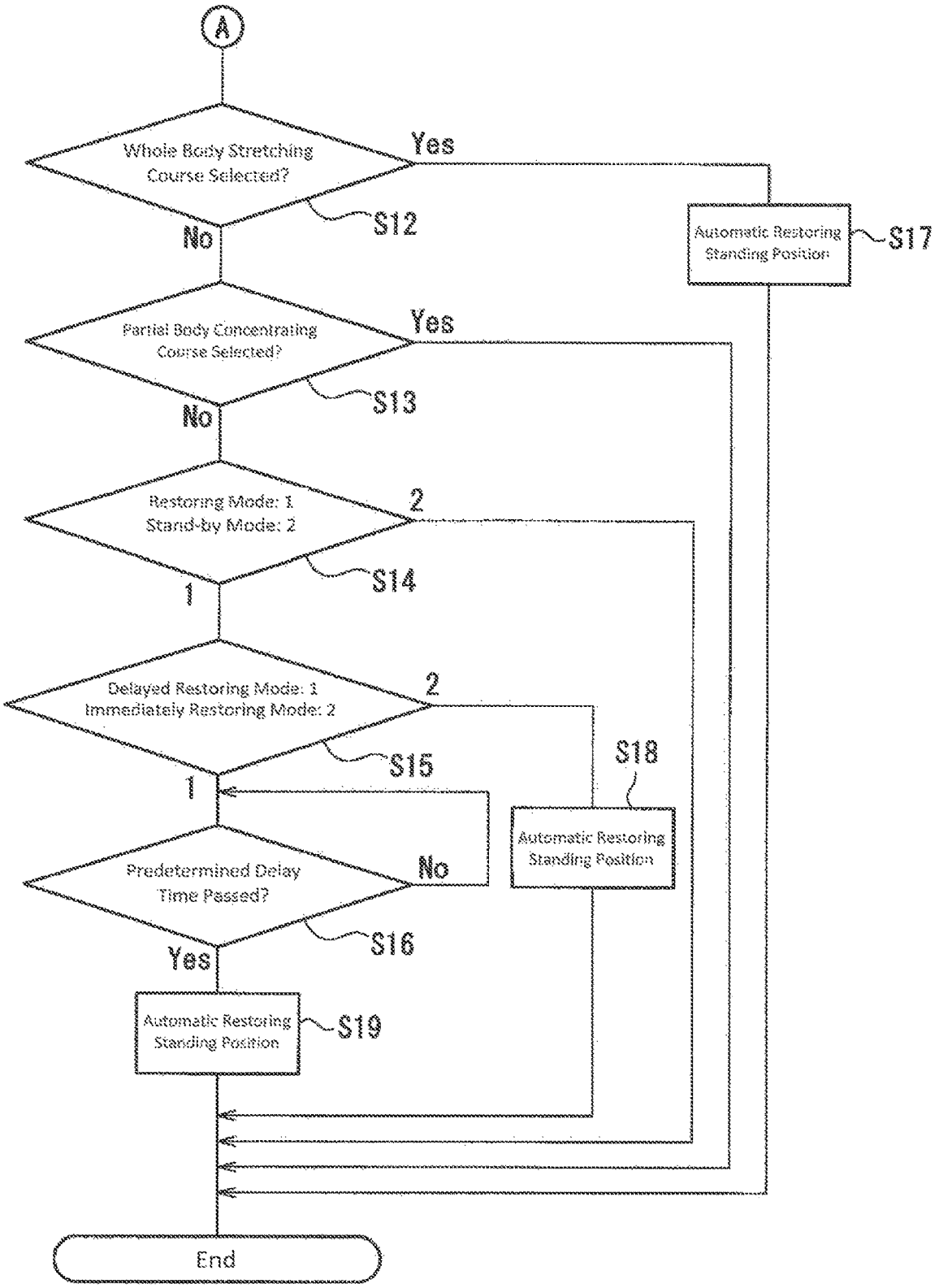
FIG. 7 is a flowchart illustrating an embodiment of a chair-type massage machine of the present invention.
Figure 8A:
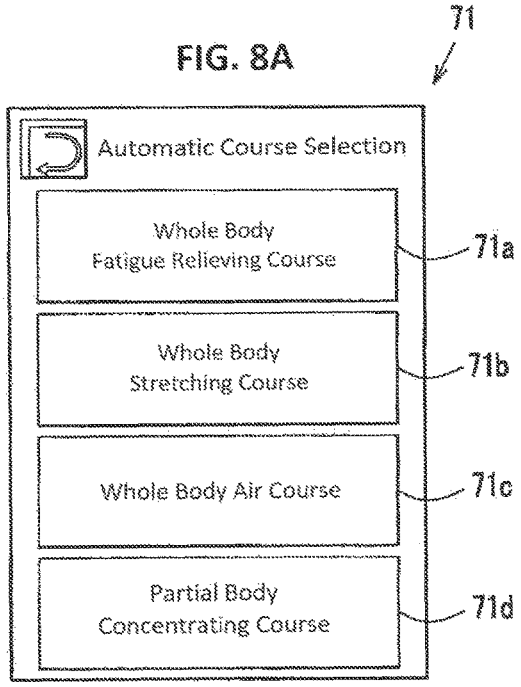
FIG. 8A through FIG. 8C are illustration diagrams illustrating one example of a selection screen displaced on a remote controller of the present invention.
Figure 8B:
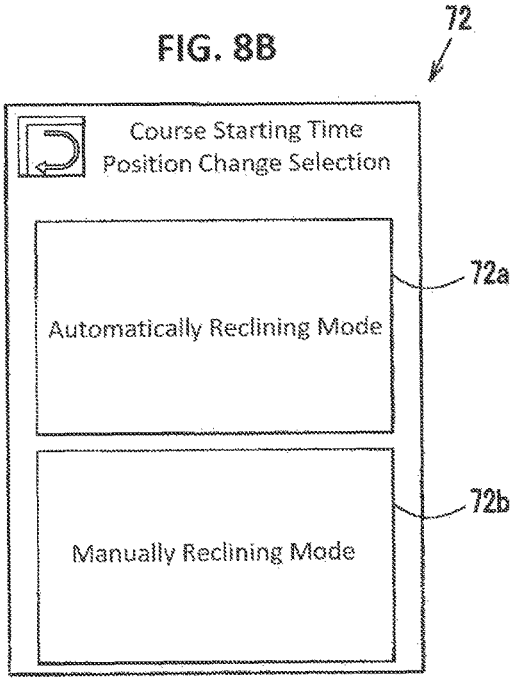
Figure 8C:
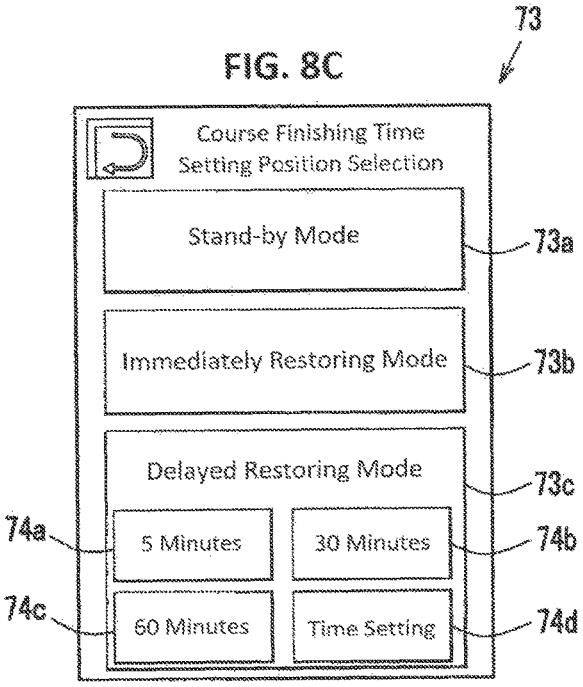

Next, one embodiment in the case where a desired massage is conducted using the chair-type massage machine 1 of the present embodiment described above, will be explained with the flowcharts of FIGS. 6 and 7, and the selection screens displayed on the display panel 43 of the remote controller 40 as shown in FIG. 8 per predetermined process. Incidentally, FIG. 8A is an illustration of an automatic course selection screen 71. FIG. 8B is an illustration of a course starting time position change selection screen 72. FIG. 8C is an illustration of a course finishing time setting position selection screen 73.

Also, a person to be treated is assumed to have a status where the person sits on the chair-type massage machine 1 with backrest portion 4 taking the standing position and the footrest portion 5 taking the waiting position, the foot portion of the person being accommodated in the foot insertion recess portion 14, and the arm portion of the person being accommodated in the arm insertion recess portion 12.

Further, in the present embodiment, for convenience, when the automatic course is the whole body fatigue relieving course, the whole body stretching course, or the whole body air course, the position at the beginning and at the end of a massage is assumed to take the reclining position. In the case where the automatic course is the partial body concentrating course, the position at the beginning and at the end of a massage is assumed to take the standing position.

First, in an automatic course selection process of the step 1, the various automatic course names are listed on the touch panel type display panel 43 as shown in FIG. 8A, and a person to be treated is allowed to select a selection menu corresponding to an arbitrary automatic course by touching the display panel. Then, based on the automatic course list table 65 of FIG. 4A, the automatic course identification code 81 corresponding to the selected automatic course is stored in the packaged code table 68 shown in FIG. 5A or FIG. 5 in the storage portion 61.

In the step 1, if the automatic courses except the partial body concentrating course is selected, such as the whole body fatigue relieving course, the whole body stretching course, or the whole body air course (the step 2: No), in the following step 3 of the course starting time position change selection process, two selection menus of "the automatically reclining mode" 72*a* for automatically reclining the backrest portion 4 and the footrest portion 5 in association with the position change of the backrest portion 4 to the reclining position and "the manually reclining mode" 72*b* for manually reclining by the operation of the operating portion 41 are displayed as the course starting time position change selection screen 72 on the touch panel type display panel 43, as shown in FIG. 8B. The person to be treated can select the selection menu by touching the display panel. In the step 3, the selected course starting time position change mode is stored in the storage portion 61 as the course starting time position change information 65.

In the course finishing time position selection process of the next step 4, the course finishing time setting position selection screen 73 is displayed on the touch panel type display panel 43 as shown in FIG. 8C, and any one of "the stand-by mode" 73*a* as the arbitrary course finishing time setting position mode, "the immediately restoring mode" 73*b* as the restoring mode, and "the delayed restoring mode" 73*c* as the restoring mode is selectable.

Further, if "the delayed restoring mode" 73*c* is selected, it is possible to additionally select one of "5 minutes" 74*a*, "30 minutes" 74*b*, "60 minutes" 74*c*, and "time setting" 74*d* depending on the delay time by selecting the selection menu of each delay time. Incidentally, by touching the "time setting" 74*d* menu of "the delayed restoring mode" 73*c*, another screen of a delay time setting screen (not shown) is displayed and it is possible to set the arbitrary delay time in minutes by the operation of the remote controller 40. Here, the course finishing time setting position identification code 82 corresponding to the selected course finishing time setting position mode, as shown in FIG. 4B, is stored in the course finishing time setting position identification code domain 91*b* of the variable packaged code 83A in the storage portion 61.

Next, in the step 5, when the selected automatic course is started by pressing the start/stop button 42*b* (the automatic course start button 42*b*) (the step 5: YES), a massage is started (the step 11) after the chair-type massage machine 1 is changed to the course starting position corresponding to the selected automatic course. To be more precise, each of initial setting reclining angles is stored as the automatic course information 64 in the storage portion 61 so that the backrest portion 4 and the footrest portion 5 can take a reclining position which is suitable for the contents of a massage at the beginning of the selected automatic course. Therefore, in the step 3, if "the automatically reclining mode" 72*a* is selected from the course starting time position change selection screen 72 (FIG. 8B) (the step 6: NO), the chair-type massage machine 1 is automatically changed to have the predetermined reclining angle which is suitable for the massage contents at the beginning of the selected automatic course (the step 7) with the position change actuator 7 being actuated by the direction from the control portion 50.

On the other hand, in the step 3, if "the manually reclining mode" 72*b* is selected (the step 6: YES), an announcement with a voice announcement by the speaker 29 and/or a display of the display panel 43 is made so that the person to be treated can change a position to the reclining position by the operation of the remote controller 40 (the step 8). At this time, the control portion 50 controls so that the start of a massage will be waited until the position change to the reclining position is complete such that the reclining angle will be within the allowable range (the step 9: NO).

Then, when the reclining angle reaches the allowable range (the step 7 or the step 9: YES), the control portion 50 reads the selected automatic course information 64 and starts a massage based on the automatic course information 64 (the step 11). Incidentally, in the step 2, if the partial body concentrating course is selected as the automatic course (the step 2: YES), by pressing the start/stop button 42*b* (the automatic course starting button 42*b*) (the step 10: YES), a massage is started with keeping the standing position which is a position at the beginning of the partial body concentrating course (the step 11).

In the step 11, the control portion 50 reads the automatic course information 64 corresponding to the automatic course identification code 81 stored in the automatic course identification code domain 91*a* shown in FIG. 5A or the automatic course identification code domain 92*a*1, 92*a*2 shown in FIG. 5B in the storage portion 61. Then, based on the automatic course information 64, the air-style massage and/or a machine-style massage is conducted at each treatment spot in a predetermined order.

When a massage of the automatic course of the step 11 is finished, and especially, the automatic course selected from the selection menus of the automatic course selection screen 71 (FIG. 8A) displayed on the display panel 43 at the step 1 is "the whole body stretching course" 71*b* (the step 12 in FIG. 7: YES), as shown in FIG. 5B, the control portion 50 detects the course finishing time setting position identification code 82 "04" stored in the fixed packaged code table 83B, based on the automatic course identification code 81 "B" corresponding to "the whole body stretching course" 71*b*. Based on the course finishing time setting position list table 66 shown in FIG. 4B, "the forced reclining position mode" is detected. Therefore, the backrest portion 4 is controlled to take the forced standing position and a massage will be finished with keeping the backrest portion 4 being the forced standing position.

With the structure described above, a person to be treated does not have to keep the person's back straight. With the position being automatically restored to the standing position, it is possible to prevent the burden from being put on the back of the person.

When a massage of the automatic course of the step 11 is finished, and especially, the automatic course selected at the step 1 is "the partial body concentrating course" 71*d* (the step 13 in FIG. 7: YES), as shown in FIG. 5B, the control portion 50 detects the course finishing time setting position identification code 82 "05" stored in the fixed packaged code table 83B, based on the automatic course identification code 81 "D" corresponding to "the partial body concentrating course" 71*d*. Based on the course finishing time setting position list table 67 shown in FIG. 4B, "the forced standing position mode" is detected. Therefore, the backrest portion 4 is controlled to maintain the standing position which is a position when a massage is finished, and a massage will be finished with keeping the standing position.

Here, the processes of the following steps 14 to 16, 18, and 19 will be explained with assuming that the automatic course selected at the step 1 is "the whole body fatigue relieving course" 71*a*, and the massage of the automatic course in the step 11 is finished (the step 12: No and the step 13: No).

Incidentally, if the automatic course selected at the step 1 is "the whole body air course" 71*c*, the processes of the steps 14 to 16, 18, and 19 will be the same as the case of "the whole body fatigue relieving course" 71*a*. Therefore, the explanation of "the whole body air course" 71*c* will be omitted.

In the case where the automatic course is the whole body fatigue relieving course, "A" as the automatic course identification code 81 shown in FIG. 4A is written in the automatic course identification code domain 91*a* in the variable packaged code table 83A shown in FIG. 5A in the storage portion 61. Incidentally, the position when a massage of the whole body fatigue relieving course is finished, that is, the course finishing time setting position is the reclining position as described above.

Also, for example, when the course finishing time setting position mode which is selected at the step 4 is "the stand-by mode" 73*a* (the step 14: 2), "01" as the course finishing time setting position identification code 82 shown in FIG. 4B is written in the course finishing time setting position identification code domain 91*b* in the variable packaged code table 83A shown in FIG. 5A in the storage portion 61.

Therefore, when the "whole body fatigue relieving course" 71*a* is finished, the control portion 50 controls the backrest portion 4 to maintain the reclining position which is a position when a massage is finished, based on "A01" as the variable packaged code 83A. Then, the massage will be finished with keeping the reclining position.

With this structure, since the backrest portion 4 is maintained to be the reclining position, as the case where the backrest portion 4 is automatically restored to the standing position at the end of the automatic course, a position change in association with the backrest portion 4 being stood is not forced to a person to be treated against the person's will. The person can indulge in the relaxed feeling right after the massage.

After the person has enjoyed the relaxed feeling after the massage, the person can rise from the reclining position with the backrest portion 4 taking the standing position by operating the remote controller 40.

Also, when the course finishing time setting position mode which is selected at the step 4 is "the immediately restoring mode" 73*b* (the step 14: 1 and the step 15: 2) (FIG. 8C) and the massage of the automatic course in the step 11 is finished, as the same manner as the process described above where the course finishing time setting position mode is "the stand-by mode" 73*a*, the control portion 50 detects "the immediately restoring mode" 73*b* based on "A02" as the variable packaged code 83A shown in FIG. 5A. The backrest portion 4 is automatically restored from the reclining position to the standing position (the step 18), and the massage will be finished.

Therefore, the chair-type massage machine 1 can take the standing position which allows a person to be treated to easily rise, and the person can smoothly rise from the chair-type massage machine 1.

Also, when the course finishing time setting position mode selected at the step 4 is "the delayed restoring mode" 73*c* and for example, the delay time of "5 minutes" is selected (the step 14: 1 and the step 15: 1) (FIG. 8C), and also the massage of the automatic course in the step 11 is finished, as the same manner as the process described above where the course finishing time setting position mode is "the stand-by mode" 73*a*, the control portion 50 controls the backrest portion 4 to be automatically restored from the reclining position to the standing position (the step 19) after 5 minutes is passed from the end of the massage (the step 16: YES), based on "A03" as the variable packaged code 83A shown in FIG. 5A. Then, the massage will be finished.

With this structure, a person to be treated can indulge in the relaxed feeling from the massage for 5 minutes after the massage is finished. After 5 minutes passes, the person can be awaken since the backrest portion 4 is raised by the automatic restoring.

Also, since the backrest portion 4 is automatically restored, the person to be treated does not have to raise the upper body from the backrest portion 4, nor stretch the arm to operate the remote controller 40 in the relaxed feeling right after the massage. In addition, there is no need to do an annoying operation such as trying to find the reclining angle change switch for the backrest portion 4 from a plurality of operation buttons 42 of the operating portion 41, and keeping pressing the reclining angle change operation button 42 until the standing position is achieved.

The chair-type massage machine 1 described above includes a seat portion 3 on which a person to be treated sits, a backrest portion 4 provided at a rear side of the seat portion 3, a position change actuator 7 provided at the backrest portion 4 as a backrest operation portion for changing an angle of the backrest portion 4 in a range of a standing position to a reclining position which reclines back, a seat portion massage portion 21 as a massage means, a backrest portion massage portion 22 as a massage means, and a foot portion massage portion 23 as a massage means. The chair-type massage machine 1 includes a control portion 50. When individually registered information 63 about a registered massage per person to be treated is reset and the backrest portion 4 takes the reclining position, the control portion 50 controls a course finishing time setting position selection screen 73 (FIG. 8C) to be displayed on a display panel 43 as a selecting means which allows either a stand-by mode 73*a* for maintaining the reclining position of the backrest portion 4 or a restoring mode (73*b*, 73*c*) for automatically restoring the backrest portion from the reclining position to the standing position to be selectable.

With the structure described above, in the case where the stand-by mode 73*a* which maintains the reclining position of the backrest portion 4 when the individually registered information the is reset, is selected, a person to be treated can be kept in the relaxed state even after a massage since the reclining position is maintained. Also, when the restoring mode (73*b*, 73*c*) is selected, the person can smoothly rise from the chair-type massage machine 1 by restoring the backrest portion 4 to the standing position. In this way, it is possible to provide a conveniently designed chair-type massage machine because the position of the backrest portion 4 at the time when the individually registered information is reset can be arbitrarily selectable, depending on preferences of the person to be treated.

As one aspect of this invention, the restoring mode (73*b*, 73*c*) includes an immediately restoring mode 73*b* for restoring the backrest portion at the end of a massage, and a delayed restoring mode 73*c* for restoring the backrest portion after a predetermined time is passed from a restoring time of the immediately restoring mode 73*b* when a massage is finished. (Refer to FIG. 8C.)

With the structure described above, by selecting the immediately restoring mode 73*b*, it is possible for a person to be treated to easily rise from the chair-type massage machine 1 because the backrest portion 4 can be immediately restored to the standing position. Also, by selecting the delayed restoring mode 73*c*, the person can be relaxed and indulge in the relaxed feeling right after a massage because the person is not forced to be raised by the position change from the reclining position to the standing position against the person's will.

In both cases of the immediately restoring mode and the delayed restoring mode, the position of the backrest portion 4 is automatically restored to the standing position. Since there is no need for a person to be treated to reach the remote controller 40 or to operate the remote controller 40, the person can indulge in the relaxed feeling right after a massage.

Further, since the position right after a massage can be arbitrarily set depending on preferences of a person to be treated, it is possible to improve the satisfaction of a person to be treated by diversifying variations of preferences.

As one aspect of this invention, the chair-type massage machine includes a storage portion 61 for storing an automatic course which has a plurality of massage forms combined in a predetermined order. Also, the chair-type massage machine includes a control portion 50 as a controlling means, wherein the controlling means changes a position of the backrest portion 4 at the end of at least one of the automatic courses to a position which is predetermined by associating with the automatic course, regardless of a selection at the course finishing time setting position selection screen 73. The control portion 50 controls based on a fixed packaged code table 83B.

With the structure described above, while the position of the backrest portion 4 at the time when the individually registered information 63 is reset, can be still selectable depending on preferences of a person to be treated by selecting the stand-by mode 73*a* for maintaining the reclining position of the backrest portion 4 or the restoring mode (73*b*, 73*c*) for automatically restoring the backrest portion from the reclining position to the standing position, it is possible to forcibly change a position of the backrest portion to a position which is predetermined by associating with the automatic course, regardless of a selection at the course finishing time setting position selection screen 73 (FIG. 8C) by the person to be treated, by giving priorities to other points, such as, the safety issue and/or the health issue of the person to be treated. Therefore, it becomes possible to ensure both of the preferences and the safety of the person to be treated.

Also, as one aspect of this invention, the chair-type massage machine includes a control portion 50. The control portion 50 controls a course starting time position change selection screen 72 to be displayed on the display panel 43 as a course starting time selecting means, wherein, in association with the beginning of the automatic course which is set depending on a massage form, the course starting time selecting means allows either an automatically reclining mode 72*a* for automatically reclining the backrest portion 4 from the standing position to the reclining position, or an manually reclining mode 72*b* for reclining the backrest portion by operating an operating portion 41, to be selectable. (Refer to FIG. 8B.)

With the structure described above, not only at the end of the automatic course, but also at the beginning of the automatic course, either the automatically reclining mode 72*a* or the manually reclining mode 72*b* is selectable. Therefore, it is possible to further diversify preferences of a person to be treated.

Also, as one aspect of this invention, in the automatically reclining mode 72*a*, the control portion 50 which is controlled by a controlling program 62 controls the backrest portion 4 and/or the footrest portion 5 such that the backrest portion 4 and/or the footrest portion 5 is reclined to be the reclining position at a suitable angle for contents of a massage at the beginning of the automatic course.

With the structure described above, since, in the automatically reclining mode 72*a*, the backrest portion 4 and/or the footrest portion 5 is reclined at a suitable angle for contents of a massage at the beginning of the selected automatic course, it is possible to smoothly and comfortably start the massage of the automatic course.

The backrest operation portion of this invention corresponds to the position change actuator 7 provided at the backrest portion 4 of the embodiment described above. In the same manner below, the massage means corresponds to the seat portion massage portion 21, the backrest portion massage portion 22, and the foot portion massage portion 23. The selecting means corresponds to the control portion 50 which controls the course finishing time setting position selection screen 73 to be displayed on the display panel 43. The footrest operation portion corresponds to the position change actuator 7 provided at the footrest portion 5. The controlling means corresponds to the control portion 50 which controls based on the fixed packaged code table 83B. The automatically reclining mode corresponds to the automatically reclining mode 72*a*. The operational reclining mode corresponds to the manually reclining mode 72*b*. The course starting time selecting means corresponds to the control portion 50 which controls the course starting time position change selection screen 72 to be displayed on the display panel 43. The massage operation notifying means corresponds to the control portion 50 which executes a massage operation notifying program 69A, which is described later. The angle change operation notifying means corresponds to the control portion 50 which executes an angle change operation notifying program 69B, which is described later. However, the present invention is not limited to the composition of the embodiment described above.

For example, at the time when the automatically restoring process of the backrest portion 4 from the reclining position to the stand position is conducted in the step 17, the step 18, or the step 19, the chair-type massage machine 1 of the present embodiment may include a control portion 50 which executes a massage operation notifying program 69A and/or an angle change operation notifying means 69B stored in the storage portion 61 as shown in the blocks with the virtual line in FIG. 2.

Figure 6:
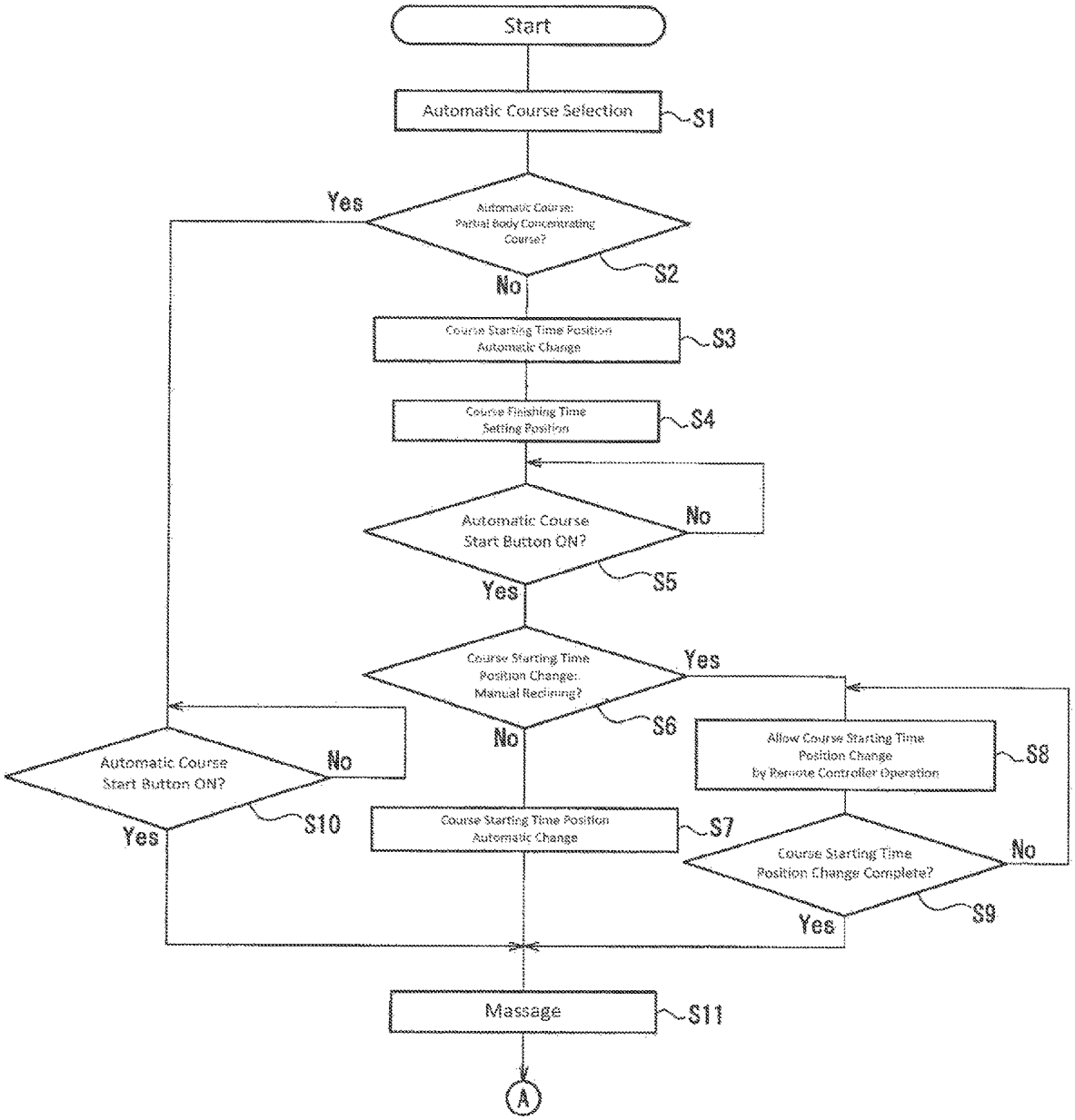
FIG. 6 is a flowchart illustrating an embodiment of a chair-type massage machine of the present invention.
Figure 9A:
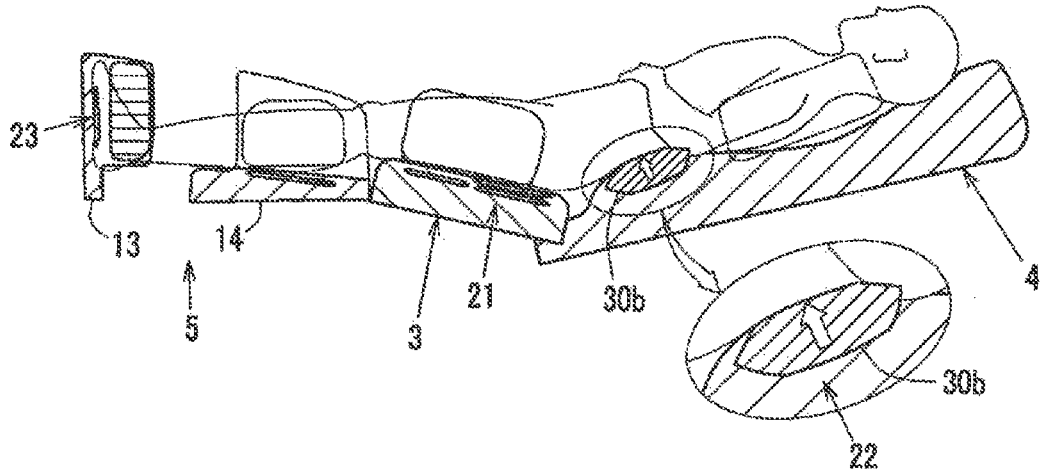
FIG. 9A and FIG. 9B are illustration diagrams illustrating an example of operations by a massage operation notifying means and an angle change operation notifying means.

Specifically, in the case where "the immediately restoring mode" 73*b* or "the delayed restoring mode" 73*c* is selected in the step 4 of the flowchart of FIG. 6, the control portion 50 can control the position change of the backrest portion 4 into the standing position, to be notified to a person to be treated at the time when the backrest portion 4 is restored to the standing position by expanding the lower back air bag 30*b* with a weaker strength than the original pressing strength, as shown, for example, in FIG. 9A, based on the massage operation notifying program 69A.

In this way, at the time of the automatic restoring, the position change of the backrest portion 4 is notified to a person to be treated by the control portion 50 having a configuration to notify the person of the position change by operating with a weaker strength than a massage strength by the massage portions 21, 22, and 23. Accordingly, the backrest portion 4 can be automatically restored in the status where the person to be treated is already awake. Therefore, the relaxed feeling right after a massage is not suddenly taken away from the person to be treated, and the person to be treated can feel relieved when the backrest portion 4 is automatically restored.

Further, as described above, by having the configuration notifying the position change using the massage portions 21, 22, and 23, the existing massage portions 21, 22, and 23 can be efficiently used and there is no need to provide an additional component.

Also, since the massage portions 21, 22, and 23 are operated with a weaker strength than a massage strength, it is possible to surely notify a person to be treated without giving the person a surprise.

Without being limited to the configuration described above, the chair-type massage machine 1 can expand and contract air bags 30 positioned at different places from the lower back air bag 30*b*. Also, it is possible to actuate the massage actuator as a machine-style massage means with a weaker strength than a massage strength. Further, it is possible to notify the person to be treated with actuating both of the air-style massage means and the machine-style massage means.

Also, based on the angle change operation notifying means 69B, or based on both of the massage operation notifying program 69A and the angle change operation notifying means 69B, the control portion 50 can notify the person to be treated of the position change by at least one of the backrest portion 4 or the footrest portion 5 being operated with a smaller angle than an angle at the position change from the reclining position to the standing position.

Figure 9B:
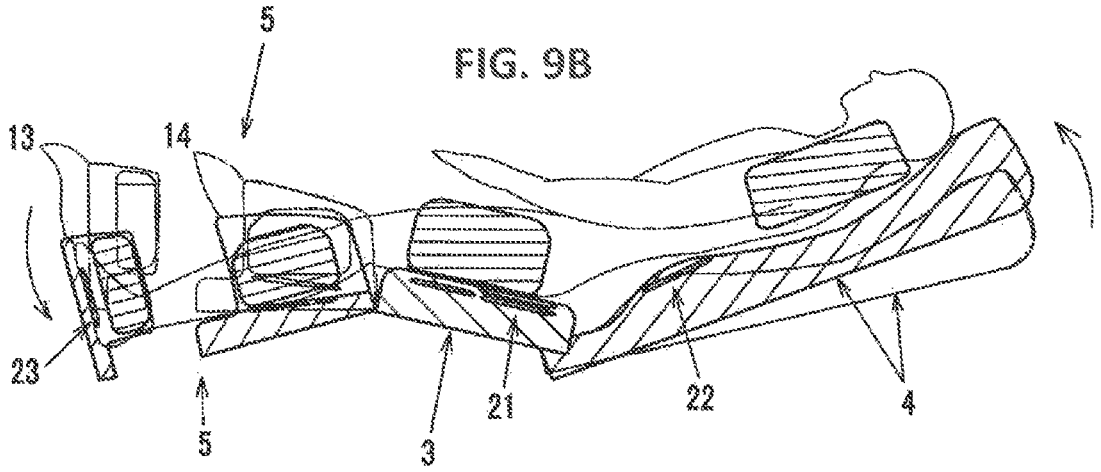

Specifically, in the case where "the immediately restoring mode" 73*b* or "the delayed restoring mode" 73*c* is selected in the step 4 of the flowchart of FIG. 6, it is possible to notify the person to be treated of the position change at the time when the backrest portion 4 is restored to the standing position by operating the backrest portion 4 and the footrest portion 5 with a smaller restoring angle, a smaller restoring speed, and a smaller restoring acceleration than original ones, as shown, for example, in FIG. 9B.

With the structure described above, there is the effect described above which is achieved by notifying the person to be treated of the position change of the backrest portion 4 at the time when the backrest portion 4 is automatically restored. Also, since at least one of the backrest portion 4 or the footrest portion 5 is operated, there is no need to additionally provide a notifying component. The position change actuator 7 provided at the backrest portion 4 and the footrest portion 5 can be efficiently used.

Incidentally, the direction where the backrest portion 4 is reclined is not limited to the direction from the reclining position to the standing position. The direction where the footrest portion 5 is reclined is not limited to the direction from the protruding position to the waiting position. The backrest portion 4 and the footrest portion 5 can be reclined to the direction where the reclining angle becomes larger. Also, it is possible that the reclining directions of the backrest portion 4 and the footrest portion 5 are different from each other.

Here, the individually registered information means the information about a registered massage per person to be treated. For example, the individually registered information includes the body information of a person to be treated, the strength and/or the speed of a massage, and a massage spot. Also, the individually registered information includes detected living body information which has been detected as needed, such as the heart rate and/or the blood pressure of the person to be treated.

The description "when individually registered information is reset" includes, for example, the time when an automatic course which has a plurality of massage forms combined in a predetermined order is finished and/or the time when a stop switch provided at a remote controller is pressed, or the time when the power switch provided at the remote controller is pressed to turn off.

When the stand-by mode is selected, the backrest portion is maintained keeping the reclining position. However, in the case where the backrest portion takes a greatly reclined reclining position at the end of a course, for example, a stretch course such that the back portion of a person to be treated is maintained to be stretched out in the rear direction at the end of the course, it is possible to have an automatically reclining configuration to adjust the angle from such a position to an easy position so that the person to be treated can be relaxed in the easy position.

As one aspect of this invention, the restoring mode includes an immediately restoring mode for restoring the backrest portion at the end of a massage, and a delayed restoring mode for restoring the backrest portion after a predetermined time is passed from a restoring time of the immediately restoring mode when a massage is finished.

With the structure described above, by selecting the immediately restoring mode, it is possible for a person to be treated to easily rise from the chair-type massage machine because the backrest portion can be immediately restored to the standing position. Also, by selecting the delayed restoring mode, the person can be relaxed and indulge in the relaxed feeling right after a massage because the person is not forced to be raised by the position change of backrest portion to the standing position against the person's will. Meanwhile, since the backrest portion is restored to the standing position after a predetermined time is passed, it is possible to prevent the person to carelessly spend too much time in the relaxed position.

In both cases of the immediately restoring mode and the delayed restoring mode, the position of the backrest portion is automatically restored to the standing position. Since there is no need for a person to be treated to reach the remote controller or to operate the remote controller, the person can indulge in the relaxed feeling right after a massage.

Further, since the position right after a massage can be arbitrarily set depending on preferences of a person to be treated, it is possible to improve the satisfaction of the person to be treated by diversifying variations of preferences.

As one aspect of this invention, the chair-type massage machine includes a notifying means, wherein when the restoring mode is selected, the notifying means notifies the person to be treated of a position change of the backrest portion from the reclining position to the standing position at the time of the automatic restoring.

With the structure described above, since the person to be treated is notified of a position change of the backrest portion at the time of the automatic restoring, it is possible to automatically restore the backrest portion after the person is awake. Therefore, the relaxed feeling right after a massage is not suddenly taken away from the person. Also, when a position of the backrest portion is automatically restored, the person can be relieved.

Here, the description "at the time of the automatic restoring" includes any cases of at the time right before the automatic restoring, at the same time as the automatic restoring, and at the time right after the automatic restoring.

Also, as one aspect of this invention, the notifying means has a massage operation notifying means which notifies the person to be treated of the position change by operating with a weaker strength than a massage strength by the massage means.

With the structure described above, by using the massage operation notifying means as the notifying means to notify a person to be treated of the position change, there is no need to have an additional operation notifying means. The massage means which is originally provided at the chair-type massage machine can be efficiently used.

Also, since the massage operation notifying means is operated with a weaker strength than a massage strength, it is possible to surely notify a person to be treated without giving the person a surprise.

As one aspect of this invention, the chair-type massage machine includes: a footrest portion provided at a front part of the seat portion; and a footrest operation portion for changing an angle of the footrest portion in a range of a standing position to a reclining position, wherein the notifying means has an angle change operation notifying means which notifies the person to be treated of the position change by at least one of the backrest portion or the footrest portion being operated with a smaller angle than an angle at the position change from the reclining position to the standing position.

With the structure described above, by using the angle change operation notifying means as the notifying means to notify a person to be treated of the position change, there is no need to have an additional operation notifying means. The backrest operation portion and/or the footrest operation portion which are originally provided at the chair-type massage machine can be efficiently used.

Also, since the angle change operation notifying means is operated with a smaller angle than an angle at the position change from the reclining position to the standing position, it is possible to surely notify a person to be treated without giving the person a surprise.

Here, the description "being operated with a smaller angle" includes the cases where the backrest portion and/or the footrest portion are operated in both of the standing direction and the reclining direction. Also, the description "being operated with a smaller angle" includes the case where the backrest portion and/or the footrest portion are repeatedly operated with short cycles such as vibrations.

As one aspect of this invention, the chair-type massage machine includes a controlling means for storing an automatic course which has a plurality of massage forms combined in a predetermined order, wherein the controlling means changes a position of the backrest portion at the end of at least one of the automatic courses to a position which is predetermined by associating with the automatic course, regardless of a selection by the selecting means.

With the structure described above, while the position of the backrest portion at the time when the individually registered information is reset, can be still selectable depending on preferences of a person to be treated by selecting the stand-by mode for maintaining the reclining position of the backrest portion or the restoring mode for automatically restoring the backrest portion from the reclining position to the standing position, it is possible to change a position of the backrest portion to a position which is predetermined by associating with the automatic course, regardless of a selection by the selecting means, by giving priorities to other points, such as, the safety issue and/or the health issue of the person to be treated. Therefore, it becomes possible to ensure both of the preferences and the safety of the person to be treated.

Also, as one aspect of this invention, the chair-type massage machine further includes a course starting time selecting means, wherein, in association with the beginning of the automatic course which is set depending on a massage form, the course starting time selecting means allows either an automatically reclining mode for automatically reclining the backrest portion from the standing position to the reclining position, or an operational reclining mode for reclining the backrest portion by operating an operating portion, to be selectable.

With the structure described above, even at the time of the beginning of the automatic course, either the automatically reclining mode or the operational reclining mode is selectable. Therefore, it is possible to further diversify preferences of a person to be treated.

Here, the description "in association with the beginning of the automatic course" includes any cases of at the time right before the automatic course starts, at the same time as the automatic course starts, and at the time right after the automatic starts.

Also, as one aspect of this invention, in the automatically reclining mode, the backrest portion is reclined to be the reclining position at a suitable angle for contents of a massage at the beginning of the automatic course.

With the structure described above, since, in the automatically reclining mode, the backrest portion is reclined to be the reclining position at a suitable angle for contents of a massage at the beginning of the automatic course, it is possible to smoothly and comfortably start the massage of the automatic course.

What is claimed is:

1. A massage machine comprising:

a seat portion on which a person to be treated sits;

a backrest portion provided at a rear side of the seat portion;

a backrest operation portion for changing an angle of the backrest portion in a range of a standing position to a reclining position which reclines back; and a massage means, wherein the massage machine comprises a display panel, and when individually registered information about a registered massage per person to be treated is reset and the backrest portion takes the reclining position, the display panel allows either a stand-by mode for maintaining the reclining position of the backrest portion, or a restoring mode for automatically restoring the backrest portion from the reclining position to the standing position by selecting a course finishing time setting position mode at a start of the registered massage, wherein a control portion controls said stand-by mode for maintaining the reclining position of the backrest portion or said restoring mode for automatically restoring the backrest portion from the reclining position to the standing position;

wherein the control portion further controls based on a fixed packaged code for storing an automatic course which has a plurality of massage forms combined in a predetermined order, wherein the control portion forcibly changes a position of the backrest portion at an end of at least one of the automatic courses to a position which is predetermined by associating with the automatic course, regardless of a selection of the course finishing time setting position mode by the display panel, wherein said position of the backrest portion at the end of said at least one of the automatic courses is either a reclining position or a standing position.

2. The massage machine according to claim 1, wherein the restoring mode includes an immediately restoring mode for restoring the backrest portion at the end of a massage, and a delayed restoring mode for restoring the backrest portion after a predetermined time is passed from a restoring time of the immediately restoring mode when a massage is finished.

3. The massage machine according to claim 1, comprising a control portion which executes an angle change operation notifying program, wherein when the restoring mode is selected, the control portion notifies the person to be treated of a position change of the backrest portion from the reclining position to the standing position at a time of the automatic restoring.

4. The massage machine according to claim 3, wherein the control portion further executes a massage operation notifying program, which notifies the person to be treated of a position change by operating with a weaker strength than a massage strength by the massage means.

5. The massage machine according to claim 3, comprising: a footrest portion provided at a front part of the seat portion; and a footrest operation portion for changing an angle of the footrest portion in a range of a standing position to a reclining position, wherein the control portion which executes the angle change operation notifying program, notifies the person to be treated of a position change by at least one of the backrest portion or the footrest portion being operated with a smaller angle than an angle at the position change from the reclining position to the standing position.

6. The massage machine according to claim 1, further comprising a control portion to control a course starting time position change selection screen to be displayed on the display panel, wherein, in association with beginning of an automatic course which is set depending on a massage form, the control portion allows either an automatically reclining mode for automatically reclining the backrest portion from the standing position to the reclining position, or an operational reclining mode for reclining the backrest portion by operating an operating portion, to be selectable.

7. The massage machine according to claim 6, wherein, in the automatically reclining mode, the backrest portion is reclined to the reclining position at a suitable angle for contents of a massage at the beginning of the automatic course.

8. The massage machine according to claim 1, wherein the restoring mode includes an immediately restoring mode for restoring the backrest portion at an end of the registered massage, and a delayed restoring mode for restoring the backrest portion after a predetermined time is passed from a restoring time of the immediately restoring mode when the registered massage is finished and said predetermined time is chosen in minutes and set by said person.

* * * * *